US008333183B2

(12) United States Patent
Nam et al.

(10) Patent No.: US 8,333,183 B2
(45) Date of Patent: Dec. 18, 2012

(54) COOKING RANGE INCLUDING AN AIR CIRCULATION MECHANISM

(75) Inventors: Hyeun Sik Nam, Seoul (KR); Dong Seong Kwag, Seoul (KR); Wan Soo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 360 days.

(21) Appl. No.: 12/764,155

(22) Filed: Apr. 21, 2010

(65) Prior Publication Data

US 2010/0276413 A1 Nov. 4, 2010

(30) Foreign Application Priority Data

Apr. 30, 2009 (KR) ..... 10-2009-0038084

(51) Int. Cl.
*F24C 3/02* (2006.01)

(52) U.S. Cl. ..... 126/273 R; 219/392

(58) Field of Classification Search ..... 219/392; 126/173 R

See application file for complete search history.

(56) References Cited

U.S. PATENT DOCUMENTS

| | | | | |
|---|---|---|---|---|
| 6,097,000 | A | 8/2000 | Frasnetti et al. | |
| 6,234,161 | B1 | 5/2001 | Levi et al. | |
| 2007/0131220 | A1* | 6/2007 | Kim et al. | 126/273 R |
| 2007/0158328 | A1* | 7/2007 | Kim et al. | 219/391 |

FOREIGN PATENT DOCUMENTS

| | | | |
|---|---|---|---|
| EP | 0833108 | A1 | 4/1998 |
| KR | 10-0487316 | B1 | 5/2005 |
| KR | 10-0476444 | B1 | 7/2005 |
| KR | 10-2006-036997 | A | 5/2006 |
| KR | 10-0650266 | B1 | 11/2006 |

OTHER PUBLICATIONS

International Search Report dated Jan. 24, 2011 for Application No. PCT/KR2010/002720, 3 pages.

* cited by examiner

*Primary Examiner* — Julio J Maldonado
*Assistant Examiner* — Robert Bachner
(74) *Attorney, Agent, or Firm* — Fish & Richardson P.C.

(57) ABSTRACT

A cooking range includes a cook top section having a heating body configured to cook foods; an oven section having a cavity and a door, wherein the cavity has a rack configured to accommodate foods and the door is configured to open or close the cavity; a heating source configured to provide heat to the cavity when the cooking range is operated; and an air circulation mechanism having a first duct, a second duct and a fan and configured to discharge air provided from the first duct positioned at a surface of the cavity through the second duct in response to rotation of the fan, wherein the air circulation mechanism is configured to discharge air from the top section through the second duct while the air provided from the first duct is discharged.

20 Claims, 4 Drawing Sheets

COOKING RANGE INCLUDING AN AIR CIRCULATION MECHANISM

CROSS-REFERENCE TO RELATED APPLICATION

The present application claims benefits of priority to Korean Application No. 10-2009-0038084, filed on Apr. 30, 2009, which is herein expressly incorporated by reference in its entirety.

FIELD

The present disclosure relates to a cooking range.

BACKGROUND

A cooking range includes an oven section indirectly heating foods using high temperature heat air to heat objects within its cabin, which forms a tight space, and a cook-top section directly heating the foods, wherein the oven section and the cook-top section are combined in a single unit.

The cooking range may be categorized into three types based on heat sources that are an electric oven range adopting an electric heater as a heat source, a microwave oven equipped with a magnetron which heats the foods via penetration of microwaves generated from a super high frequency oscillator into the foods, and a gas oven using flames from a gas fuel burner for heating the foods. Likewise, the cooking range may be categorized based on heat sources of the cook top section.

A conventional cooking range includes a cavity that is heated for cooking food. The cavity is opened or closed by a door that is moveable to provide access to the cavity. An internal cavity is horizontally defined with racks provided to enable multiple trays, pans or pots of food items to be placed therein at different levels within the cavity. The racks are moveable toward the door along a guide rail positioned inside the cavity. The cook top section is defined with a controller for displaying a user menu and controlling an entire operation of the cooking range.

When foods are cooked, heat from the cavity is transmitted to an outer case and the cook top section of the oven section, whereby a locally-overheated hot spot is generated. Among other things, the hot spot may increase the temperature of kitchen furniture surrounding a built-in range or cause an erroneous operation of the controller at the cook top section.

SUMMARY

In one aspect, a cooking range includes a cook top section having a heating body configured to cook foods; an oven section having a cavity and a door, wherein the cavity has a rack configured to accommodate foods and the door is configured to open or close the cavity; a heating source configured to provide heat to the cavity when the cooking range is operated; and an air circulation mechanism having a first duct, a second duct and a fan and configured to discharge air provided from the first duct positioned at a surface of the cavity through the second duct in response to rotation of the fan, wherein the air circulation mechanism is configured to discharge air from the top section through the second duct while the air provided from the first duct is discharged.

In another aspect, a cooking range includes a cook top section having a heating body configured to cook foods; an oven section having a cavity and a door, wherein the cavity has a rack configured to accommodate foods and the door is configured to open or close the cavity; a heating source configured to provide heat to the cavity when the cooking range is operated; and an air circulation mechanism configured to circulate air within the cooking range includes a first duct positioned at a surface of the cavity and configured to guide air that is circulated; a second duct positioned on the oven section and configured to guide circulated air in a direction in response to rotation of a fan; and an upper slot positioned on the first duct and configured to communicate the air between the first duct and the second duct.

BRIEF DESCRIPTION OF DRAWINGS

FIG. 3 is a view of the cooking range; and.

DETAILED DESCRIPTION

The structure and operation of the cooling range will be described with reference to FIGS. 1 to 4. The cooking range 100 may be categorized into two types based on installation, which are a free standing type and a built-in type. The free standing type is an independent type in that the cooking range 100 is independently located from a kitchen furniture 10. On the contrary, the built-in type is a combination type in that the cooking range 100 is positioned between the side cover 230 and the kitchen furniture 10.

For example, the built-in type cooking range may not need installation of the side covers 230. In addition, the cooking range further may include a hybrid type capable of being used as a built-in type as well as a free standing type. The hybrid type may be installed either independently or combined with the kitchen furniture 10.

Figure 1:
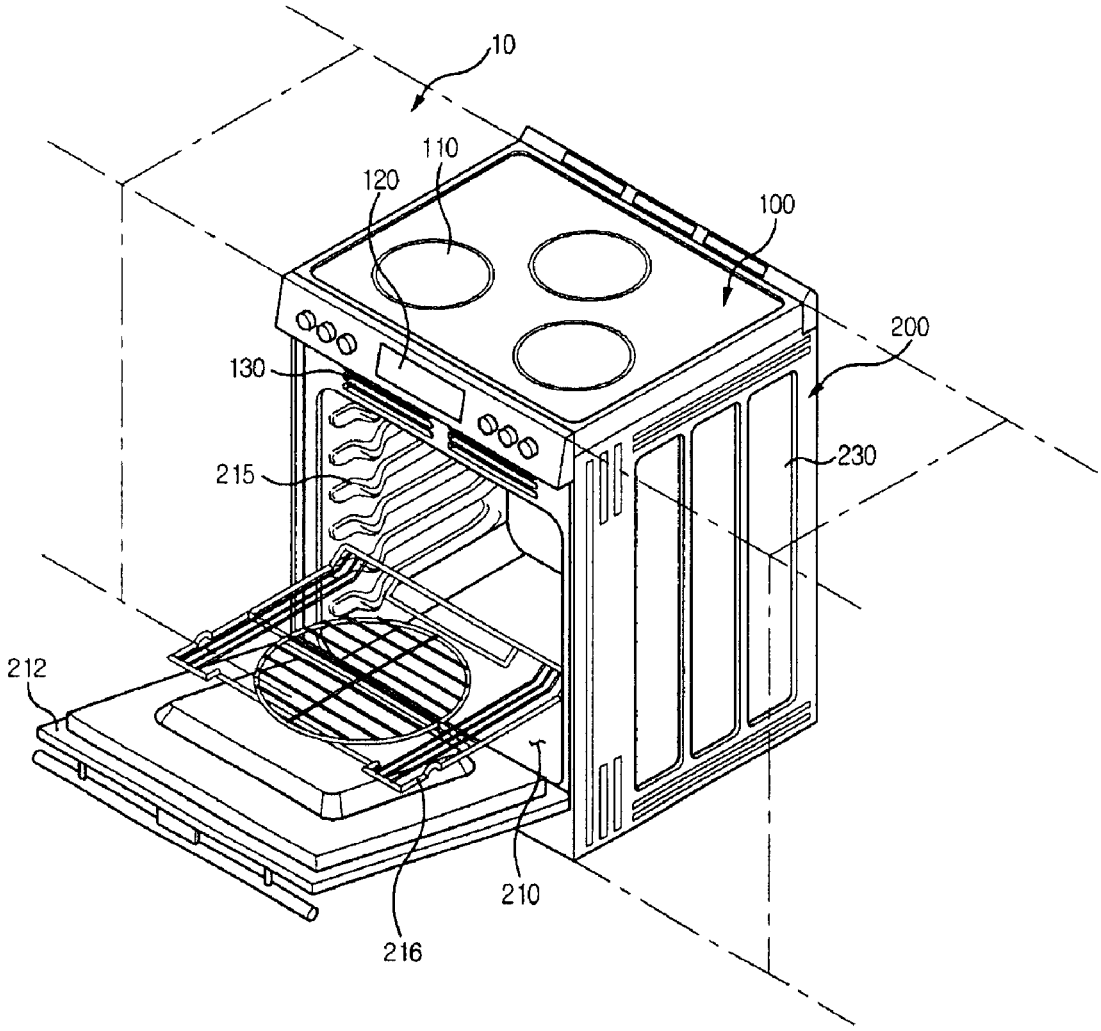
FIG. 1 is a view of a cooking range.

As shown in FIG. 1, the cooking range includes an oven section 200 indirectly heating foods by using a high temperature heat air in a tight space, and a cook-top section 100 positioned at an upper side of the oven section 200 directly heating the foods.

In some examples, a heat source for heating the oven section 200 may be an electric heater, a microwave, a gas flame or the like. The oven section 200 may include a cavity 210, a door 212 and side covers 230.

The cavity 210 having a space for cooking food, is opened or closed by the door 212. A rack 216 on which foods are placed is coupled to the cavity 210. In this implementation, the cavity 210 may be coated with enamel or other coating material to enable easily cleaning of an interior of the cavity. The rack 216 has a guide member 215 that is configured to guide the rack 216. Also, the rack 216 is located inside of the cavity 210 when the door is closed and configured to move in a forward direction when the door is open.

Therefore, the rack 216 allows food to be put into the cavity 210 for cooking or to be taken out from the cavity 210 when the foods are done in the cooking range. Each of the side covers 230 defines an exterior view of the cooking range. Insulation material 240 may be interposed between the side cover 230 and the cavity 210. The insulation material may reduce or prevent heat from the cavity 210 to be transmitted to ambience of the cooking range.

The cook top section 100 may have a heating body 110 for cooking the foods. The heating body 110 includes a heating source, such as a gas burner, an electric burner, a ceramic heater, a microwave or the like.

The cook top section 100 also may have a controller 120 for displaying a user menu and controlling an entire operation of the cooking range. For example, the controller 120 performs control functions that detect an internal temperature of the cavity 210 and the cooked condition of the foods, and control the oven section 200 to minimize the food burnt or over-cooked.

The controller 120 may also display various menus on a display unit so that a user can select a desired menu therefrom. The controller 120 may further perform control functions such as residual heat display function that displays residual heat, reservation function, timer function and self cleaning function that automatically clean an interior of the cavity 210. For example, the controller 120 include a microprocessor that is mounted on a Printed Circuit Board (PCB).

If heat is concentrated on a portion of the cooking range, for example, near the controller 120 which is sensitive to static electricity or heat may be erroneously operated or damaged. For example, when the cavity 210 may rise up to a high temperature during performance of self cleaning function, the controller should stand out under the condition of the heat concentration.

Furthermore, in case that the cooking range is the built-in type, the cooking range installed in a tightly-sealed space of the kitchen furniture 10 may decrease the cooling efficiency and stand out the heat concentration phenomenon, whereby the kitchen furniture 10 positioned around the cooking range may be overheated (e.g., 90° C. or more) when the cooking range is operated.

The overheating phenomenon may be reduced by using insulation material 240 that wraps an upper side and lateral surfaces of the cavity 210. Further, an air circulation system that circulates the hit to an exterior may reduce the heat transmitted to a portion of the cooking range such as side covers 230 adjacent to the kitchen furniture 10 or the controller 120.

Further, if the cooking range is a hybrid type capable of being used in a built-in type and a free standing type, the controller 120 may be positioned at an upper side of the oven section 200 or a front surface of the cook top section 100.

The air circulation system is configured to have a structure capable of circulating the air in order to reduce the heat that is concentrated on the upper front surface of the oven section 200 on which the controller 120 is mounted. In the description, the front direction refers to a direction facing the door 212, and the rear direction refers a direction facing a rear wall positioned inside the cavity 210.

Figure 3:
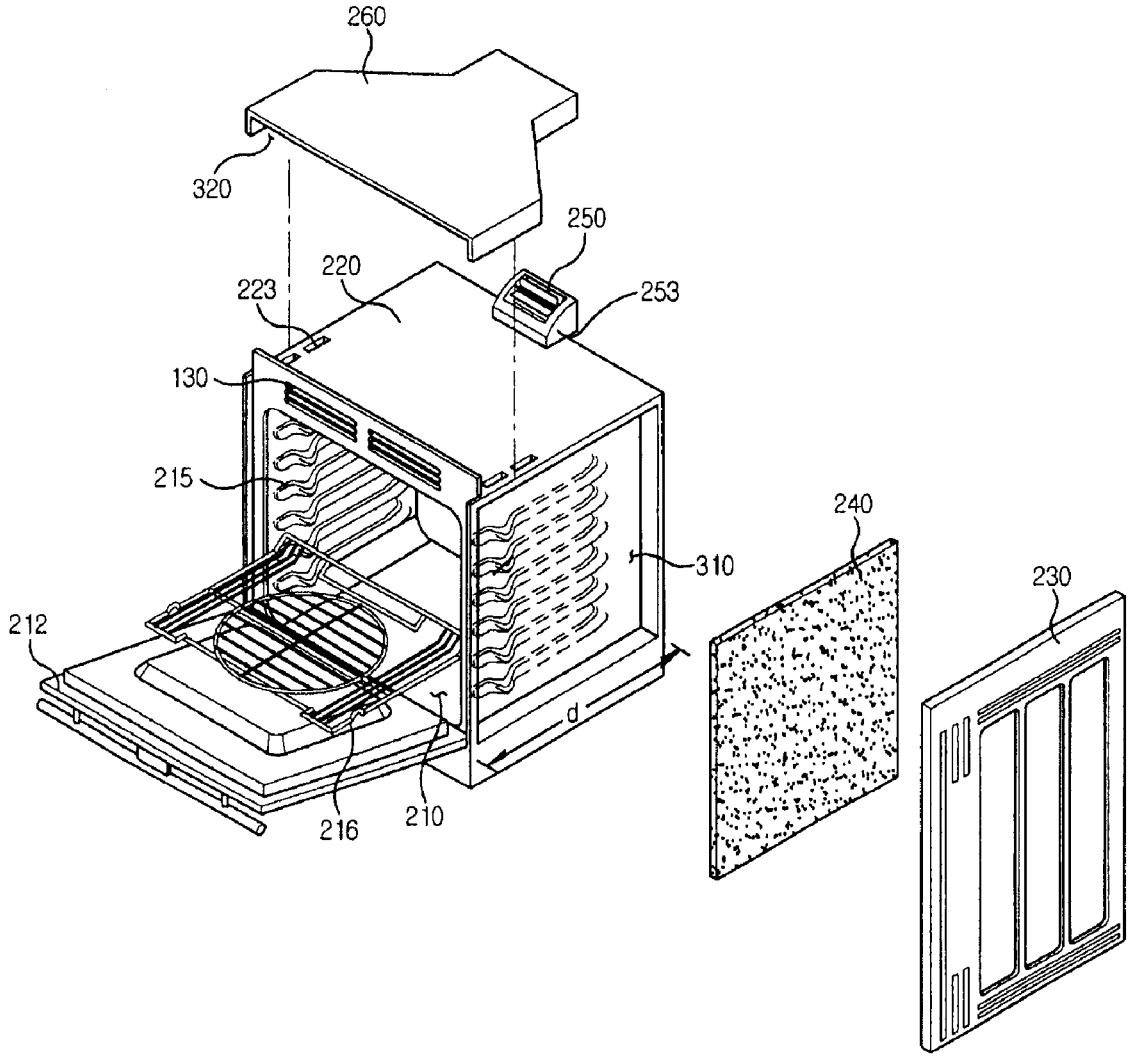

Referring to FIG. 3, if the cooking range is the free standing type, a first duct 310 is positioned at an empty space between the side cover 230 and the oven section 200 through which ambient air of the oven section 200 is circulated by way of convection. However, if the cooking range is the built-in type, there is a probability of the controller 120 or the side covers 230 being overheated, such that a cooling fan 250 may be needed to improve the cooling efficiency by way of forcing air circulation.

Figure 2:
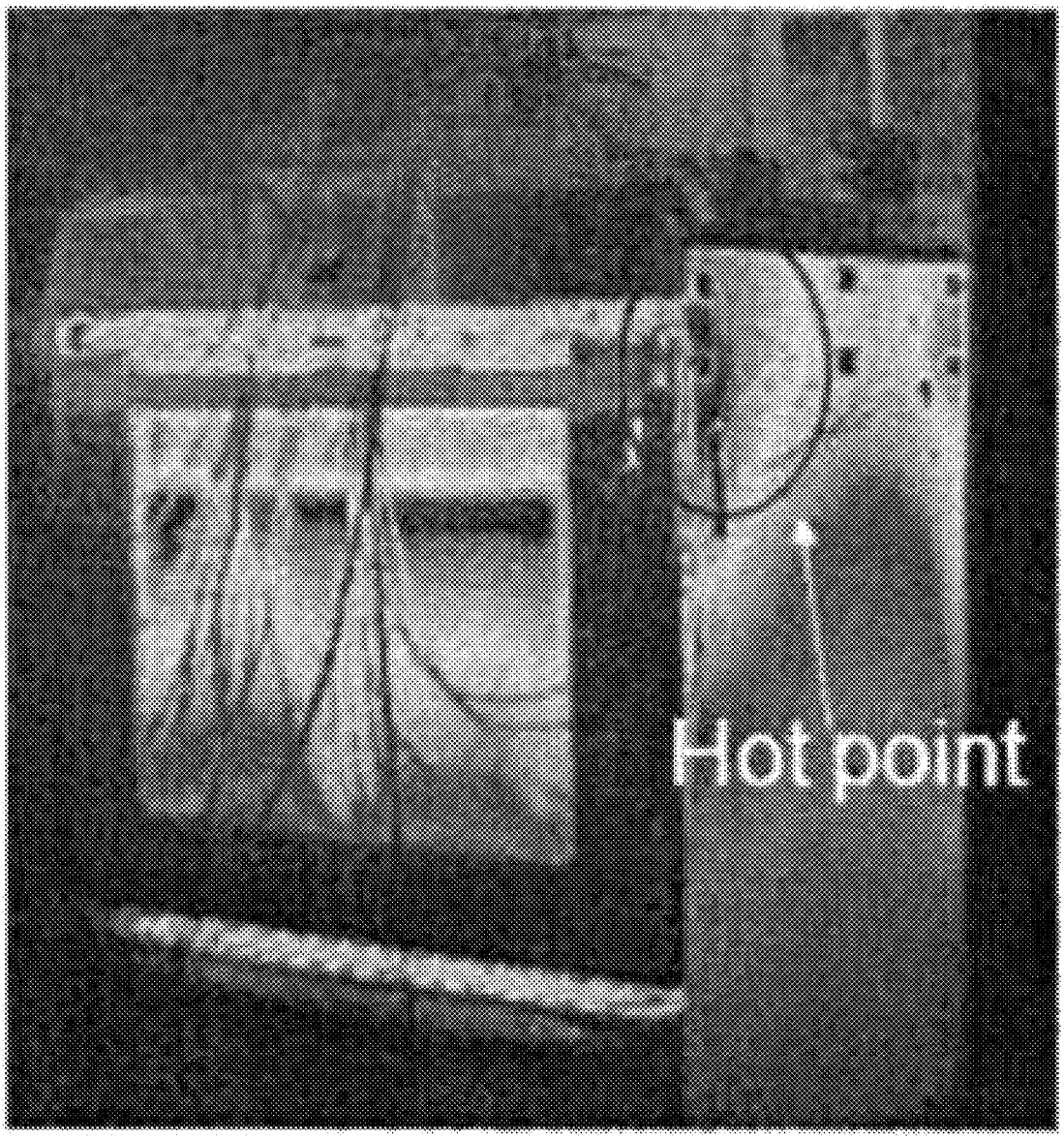
FIG. 2 is a photograph showing a measurement of temperature distribution around an oven section.

Referring to the photograph illustrated in FIG. 2, a portion where temperature is high is indicated in red color. Without the air circulation system a hot spot is defined by a concentration of red color, positioned at an upper front surface of the oven section 200. That is, the heat is concentrated on the upper side of the oven section 200 by the heat generated from the cavity 210. For example, the upper front surface of the oven section 200 is indicated as the hot point. The concentration of heat may be caused by insufficient circulation of air that is around the cavity 210 for example, on the upper front surface of the oven section 200.

The rising hot air further may increase the temperature at the upper side of the oven section 200. Although there is an empty space at the rear surface of the oven section 200 in which air can circulate, the front surface of the oven section 200 where the door 212 is mounted is defined with a smaller empty space for air circulation, which may be the cause of the heat concentration.

Referring to FIG. 3, the air circulation system may include a first duct 310, a second duct 320, a cooling fan 250 and at least one of an upper surface slot 223, an upper surface panel 220 and a front surface slot 130.

Both sides of the oven section 200 are installed by the first duct 310 which is an empty space defined by a lateral surface of the cavity 210 and the side cover 230. In a case insulation material 240 is positioned at the lateral surface of the cavity 210, the air circulates between the insulation material 240 and the side cover 230.

The second duct 320 has an empty space. Since the second duct 320 is covered with an upper side of the oven section 200, as shown in FIG. 3, the empty space of the second duct 320 can be connected to the first ducts 310 at both sides of the oven section 200. The second duct 320 is therefore positioned between the upper side of the cavity 210 and a duct plate 260. In case an upper side of the cavity 210 is defined with an upper panel 220 and an insulation material 240 that is interposed between the upper side of the cavity 210 and the upper panel 220, barriers formed by the second duct 320 are the upper side 220 and the duct plate 260, if put in more detail.

The cooling fan 250 is mounted on a rear surface of the second duct 320 to move the heat in a forward or a backward direction. Rear surfaces of the cooling fan 250 and the second duct 320 are connected to a cooling fan hole 253.

Although not shown in the drawings, the controller 120 can detect whether there is any heat concentration around the oven section 200 by using one or more temperature sensors positioned at the cover 230, an interior of the cavity 210 and/or the upper side of the cavity 210, and control the rotation speed and rotation direction of the cooling fan 250 based on the detected temperature, whereby the heat in the hot spot is concentratively reduced.

The upper slot 223 creates an air flow path between the first duct 310 and the second duct 320 as shown in FIG. 3. For example, the upper slot is located at both corners of the upper panel 220. In order to concentratively cool the controller 120 or the upper front surface of the oven section 200, an air circulation system circulate the heat concentrated on around the controller 120 or the upper front surface of the oven section 200. The air circulation system includes the upper slot 223 located at a front surface of both corners of the upper panel 220. A shape of the duct plate 260 as shown in FIG. 3 is that a front portion is wide enough to cover the upper slot 223 located in both sides of the upper panel and a rear portion is narrow to blow the heat to an exterior in the forward direction.

In this implementation, the configuration is not limited to the above structure. For example, if the upper slot 223 is located across an entire length of both corners of the upper panel 220, the front portion of the duct plate 260 may be designed to fully cover the upper slot 223. The air circulation can be concentrated on the upper front surface of the oven section 200.

In some exemplary implementations, regardless of whether the upper slot 223 is formed at part of both corners of the upper panel 220 or an entire corners of the upper panel 220, the first duct 310 and the second duct 320 communicate through the upper slot 223 defined at any points from the half point of the entire depth-wise length (d) of the oven section 200 up to the front surface of the oven section 200.

A front slot 130 may be defined as an air circulation path at an upper side of the door 212, and a front surface of the second duct 320 is connected to the front slot 130.

The door 212 may be connected to a front surface of the oven section 200 when the door 212 is closed. In this implementation, a portion of the door that is, for example, edge side of the rectangular shape door, is contacted with the front surface of the oven section 200. To reduce the heat that concentrated on the upper front surface of the oven section 200, a plate may be attached to the portion of the door connected to the oven section so that the plate reduces the heat transfer to other place, for example, the controller 120, when the door 212 is closed. Alternatively, since the heat is concentrated on the upper portion, the plate may be attached to an upper portion of the door 212. As shown in FIG. 1, the door has a guiding part to firmly contact with the oven section 200. The plate may be attached to the guiding part of the door. The plate may be made of Aluminum or other material. The plate may be coated with a coating material.

Figure 4:
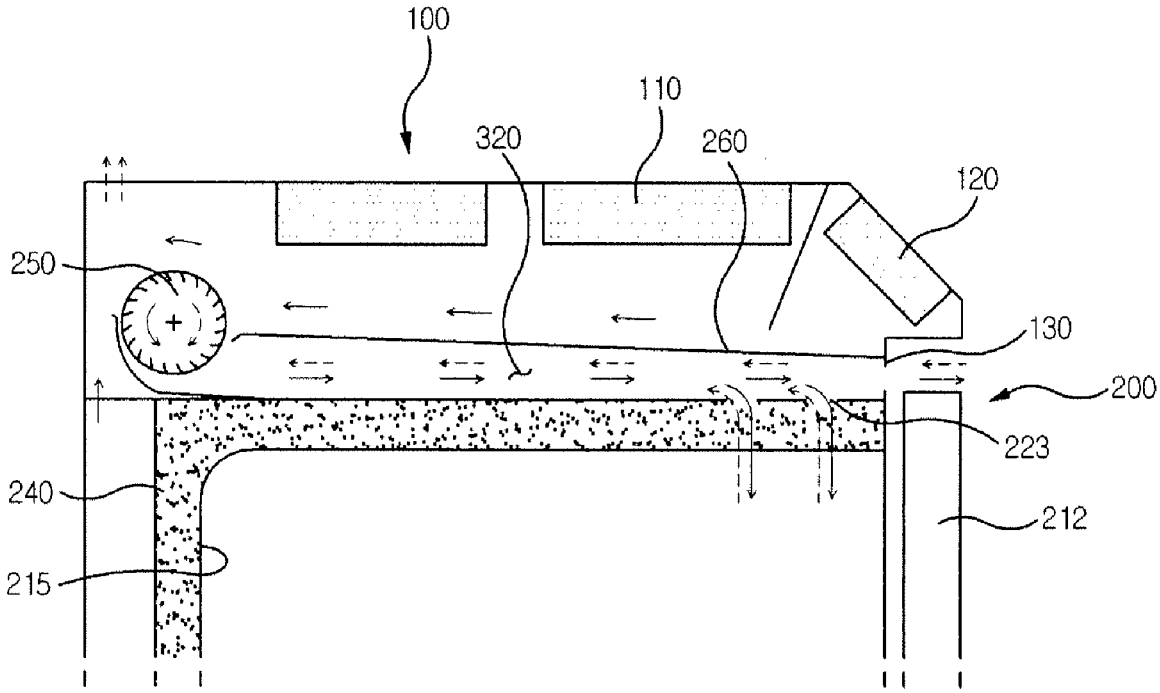
FIG. 4 is a lateral cross-sectional showing circulation of air.

An air circulation path is shown in FIG. 4. Referring to FIG. 4, solid arrow lines show an air circulation direction when the cooling fan 250 rotates in the forward direction, and dotted arrow lines show an air circulation direction when the cooling fan 250 rotates in the backward direction.

In some implementations, the air that has sequentially passed through the cook top section 100, the cooling fan 250 and the second duct 320 may be discharged to the first duct 310 or the front slot 130 when the cooling fan 250 rotates in the forward direction.

The air that has passed through the first duct 310 or the front slot 130 may be discharged to the outside through the second duct 320, the cooling fan 250 and the cook top section 100, in that order, when the cooling fan 250 rotates in the backward direction.

Accordingly, the heat in the space closed by the insulation material 240, the side cover 230 and the upper panel 220 can be discharged by the air circulation system. Thereby, the hot spot of the side cover 230 can be reduced and heat amount transmitted to the controller 120 can be also reduced.

As apparent from the foregoing, there is an advantage in the cooking range including air circulation system in that the cooking range can reduce the generation of hot spot of the side cover and temperature rise of the controller.

Furthermore, another advantage is that the cooking range including air circulation system can prevent the kitchen furniture connected with the side cover from being over-heated, thereby securing reliability and safety.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A cooking range comprising:

a cook top section having a heating body configured to cook foods;

an oven section having a cavity and a door, wherein the cavity has a rack configured to accommodate foods and the door is configured to open or close the cavity;

a heating source configured to provide heat to the cavity when the cooking range is operated; and an air circulation mechanism having a first duct, a second duct and a fan and configured to discharge air provided from the first duct positioned at a surface of the cavity through the second duct in response to rotation of the fan, wherein the air circulation mechanism is configured to discharge air from a top section through the second duct while the air provided from the first duct is discharged, wherein the air circulation mechanism comprises an upper slot configured to connect the first duct and the second duct, and wherein the upper slot is positioned between a mid-point of the first duct and a front surface of the oven section, and extends from a mid-point of an entire depth-wise length of the oven section up to a front surface of the oven section.

2. The cooking range of claim 1, wherein the second duct comprises:

a duct plate positioned on a side of the cavity to cover the cavity; and an upper slot connecting between the first duct and the second duct.

3. A cooking range comprising:

a cook top section having a heating body configured to cook foods;

an oven section having a cavity and a door, wherein the cavity has a rack configured to accommodate foods and the door is configured to open or close the cavity;

a heating source configured to provide heat to the cavity when the cooking range is operated; and an air circulation mechanism having a first duct, a second duct and a fan and configured to discharge air provided from the first duct positioned at a surface of the cavity through the second duct in response to rotation of the fan, wherein the air circulation mechanism is configured to discharge air from a top section through the second duct while the air provided from the first duct is discharged, wherein the air circulation mechanism comprises an upper slot configured to connect the first duct and the second duct, and wherein the upper slot is positioned between a mid point of the first duct and a front surface of the first duct, and extends from a mid-point of an entire depth-wise length of the oven section up to a front surface of the oven section.

4. The cooking range of claim 1, wherein the second duct comprises;

an upper surface panel provided on the cavity; and a duct plate covering the upper surface panel.

5. The cooking range of claim 1, wherein the fan is positioned at a rear surface of the second duct.

6. The cooking range of claim 1, wherein the cook top section having at least one holes that is configured to supply air from an exterior.

7. The cooking range of claim 1, wherein the air passed through the cook top section or the second duct is discharged to the first duct when the cooling fan rotates in a reverse direction.

8. The cooking range of claim 1, further comprising:

a controller having a microprocessor positioned on a front surface of the top section and configured to perform functions such as determining a cooking condition of the foods and controlling the oven section.

9. The cooking range of claim 1, further comprising:

a detector configured to detect a temperature of the oven section; and a controller configured to control the fan speed based on the detected temperature.

10. The cooking range of claim 9, wherein the detector is positioned on an upper surface of the oven section.

11. The cooking range of claim 1, further comprising:

a controller having a display unit, positioned on a front surface of the top section and configured to display a user menu.

12. The cooking range of claim 1, wherein the first duct is an empty space defined by a lateral surface of the cavity and a side cover.

13. The cooking range of claim 12, further comprising insulation material positioned at the lateral surface of the cavity, wherein air circulates between the insulation material and the side cover.

14. The cooking range of claim 12, wherein the second duct is covered with an upper side of the oven section and an empty space of the second duct is connected to the first duct at a side of the oven section.

15. The cooking range of claim 14, wherein the second duct is positioned between an upper side of the cavity and a duct plate.

16. The cooking range of claim 15, wherein the cavity is defined with an upper panel and insulation material that is interposed between the upper side of the cavity and the upper panel, and wherein the upper side of the cavity and the duct plate are barriers that define the second duct.

17. The cooking range of claim 15, wherein the cooling fan is mounted on a rear surface of the second duct to move heat in a forward or a backward direction.

18. The cooking range of claim 17, wherein rear surfaces of the cooling fan and the second duct are connected to a cooling fan hole.

19. The cooking range of claim 15, wherein the upper slot is located at a front surface of both corners of the upper side of the cavity.

20. The cooking range of claim 19, wherein a front portion of the duct plate is wide enough to cover the upper slot located at both sides of the upper side of the cavity and a rear portion of the duct plate is narrower than the front portion to blow heat to an exterior in a forward direction.

* * * * *